US006837561B2

(12) United States Patent
Yazdy

(10) Patent No.: US 6,837,561 B2
(45) Date of Patent: Jan. 4, 2005

(54) CURRENT SWITCHING ARCHITECTURE FOR HEAD DRIVER OF SOLID INK JET PRINT HEADS

(75) Inventor: Mostafa R. Yazdy, Los Angeles, CA (US)

(73) Assignee: Xerox Corporation, Stamford, CT (US)

( * ) Notice: Subject to any disclaimer, the term of this patent is extended or adjusted under 35 U.S.C. 154(b) by 58 days.

(21) Appl. No.: 10/284,542

(22) Filed: Oct. 30, 2002

(65) Prior Publication Data

US 2004/0085372 A1 May 6, 2004

(51) Int. Cl.[7] ..... B41J 29/38
(52) U.S. Cl. ..... 347/12; 310/317
(58) Field of Search ..... 347/9–12, 68; 310/317; 323/315

(56) References Cited

U.S. PATENT DOCUMENTS 5,212,497 A * 5/1993 Stanley et al. ..... 347/19
6,086,190 A 7/2000 Schantz et al. ..... 347/81
6,102,513 A 8/2000 Wen ..... 347/15
6,104,178 A * 8/2000 Sugimoto ..... 323/315
6,305,773 B1 * 10/2001 Burr et al. ..... 347/11
6,382,754 B1 5/2002 Morikoshi et al. ..... 347/11
6,412,923 B1 7/2002 Takahashi ..... 347/68

FOREIGN PATENT DOCUMENTS

JP 9-150505 * 6/1997 ..... B41J/2/45
JP 2001-150666 * 6/2001 ..... B41J/2/45

* cited by examiner

*Primary Examiner*—Lamson Nguyen
*Assistant Examiner*—Blaise Mouttet
(74) *Attorney, Agent, or Firm*—Oliff & Beeridge, PLC

(57) ABSTRACT

Circuit architecture for driving piezoelectric transducers with a Head Drive ASIC powered with only regular (constant) power supplies (instead of ramped and shaped power supplies) is disclosed. The circuit architecture consists of current mirroring systems and current switching techniques used to generate the required particular voltage waveforms across the capacitive transducers using only constant (DC) power supplies. There is no need for high voltage switching elements in this approach.

17 Claims, 4 Drawing Sheets

CURRENT SWITCHING ARCHITECTURE FOR HEAD DRIVER OF SOLID INK JET PRINT HEADS

CROSS REFERENCE TO RELATED APPLICATION

Attention is directed to copending applications 10/284,559 entitled, "Normalization of Head Driver Current for Print Head" 10/284,558 entitled, "Normalization of Head Driver Current for Solid Ink Jet Print Head By Current Slope Adjustment", both filed herewith. The disclosures of these references are hereby incorporated in their entirety.

BACKGROUND OF THE INVENTION

On Ink Jet Print Heads Piezo-electric transducers are used to eject ink drops. Positive and negative voltages in particular waveforms are required for this purpose: the positive voltage to fill the orifices with the ink and the negative voltage to eject the ink drops. The shapes of such waveforms are determined by the type of the ink and the specific characteristics of the print heads. A Head Drive ASIC (HDA) is used to provide such waveforms. The amplitude of the output voltage across each transducer on the print head must be individually adjusted to compensate for sensitivity variations of different piezo-electric elements on the print heads. This is called "normalization" or "calibration". In present Head Driver ASIC design, a digital method is used for normalization procedure. An alternate method can simplify the circuitry and improve the normalization accuracy.

A simplified block diagram of the circuitry used in prior art Head Driver ASIC and related signal waveforms are shown in FIGS. 1 and 2 respectively. VPP 10 and VSS 12 are the positive and the negative power supplies with voltages in particular shapes as shown. The piezo-electric transducer has a capacitive load and is shown by a capacitor Cpz 14. Two switches, switch S1 16 and switch S2 18, connect the transducer to VPP 10 and VSS 12 respectively. The polarity of a signal, called POL (polarity) 20, determines which power supply (VPP or VSS) is connected to the transducer 14. The output voltage (Vout) 22 across each transducer 14 should reach a specific level determined by a 6-bit data stored in a 6-bit latch 24 as shown in FIG. 1. This allows the voltage across each transducer 14 to be trimmed to a determined value in order to compensate for sensitivity variations of different transducers on the print head. This procedure is called "Normalization" or "Calibration".

Referring once again to FIGS. 1 and 2, assuming that the print data is "1", a signal call SEL (select) 26 goes high at time t1 28, switch S1 16 is closed connecting the output transducer 14 to VPP 10 and the output voltage (Vout) 22 across the transducer 14 follows VPP 10. VPP 10 has a high slope between t1 28 and t2 (fast slew) 30 and after t2 30 slope is lower for normalization purpose. At time t2 30, when the slope of VPP 10 is changed, a signal NOM_CEN (Normalization Counter Enable) 32 goes high and triggers a 6-bit counter 34. The output of the counter 34 is compared to the normalization data (B0B1B2B3B4B5) stored in the 6-bit latch 24 in the delay circuit 36 (shown in FIG. 2) and when it matches that data a signal called NORM_LATCH 38 goes low at time t3 40. So basically the delay circuit 36 generates a signal delayed from t2 30 and the amount of delay is determined by 6-bit data stored in 6-bit latch 24. At this time (t3) 40 the signal NORM_LATCH 38 is used to disconnect the output from VPP 10 and the capacitive load of the transducer 14 keeps the output voltage 22 at this level, so the voltage across the transducer 14 is adjusted by 6-bit normalization data.

At time t4 42 the POL (polarity) signal 20 goes low and switch S2 18 is closed connecting the transducer 14 to negative supply VSS 12 and Vout 22 follows VSS 12. Similarly at time t5 44 the slope of VSS 12 is changed and the 6-bit counter 34 is triggered again and at time t6 46, delayed from t5 44 based on normalization data B0B1B2B3B4B5, the transducer 14 is disconnected from VSS 12 and keeps its voltage at this level. As a result the output voltage 22 shown in FIG. 2 is generated across the transducer 14 which is basically shaped by the predetermined shapes of VSS 12 and VPP 10 and its amplitudes are adjusted by "normalization" data.

SUMMARY OF THE INVENTION

Circuit architecture for driving Piezo-electric transducers with a Head Drive ASIC powered with only regular (constant) power supplies (instead of ramped and shaped power supplies) is disclosed. The circuit architecture consists of current mirroring systems and current switching techniques used to generate the required particular voltage waveforms across capacitive transducers using only constant (DC) power supplies. There is no need for high voltage switching elements in this approach.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE DRAWINGS

Figure 1:
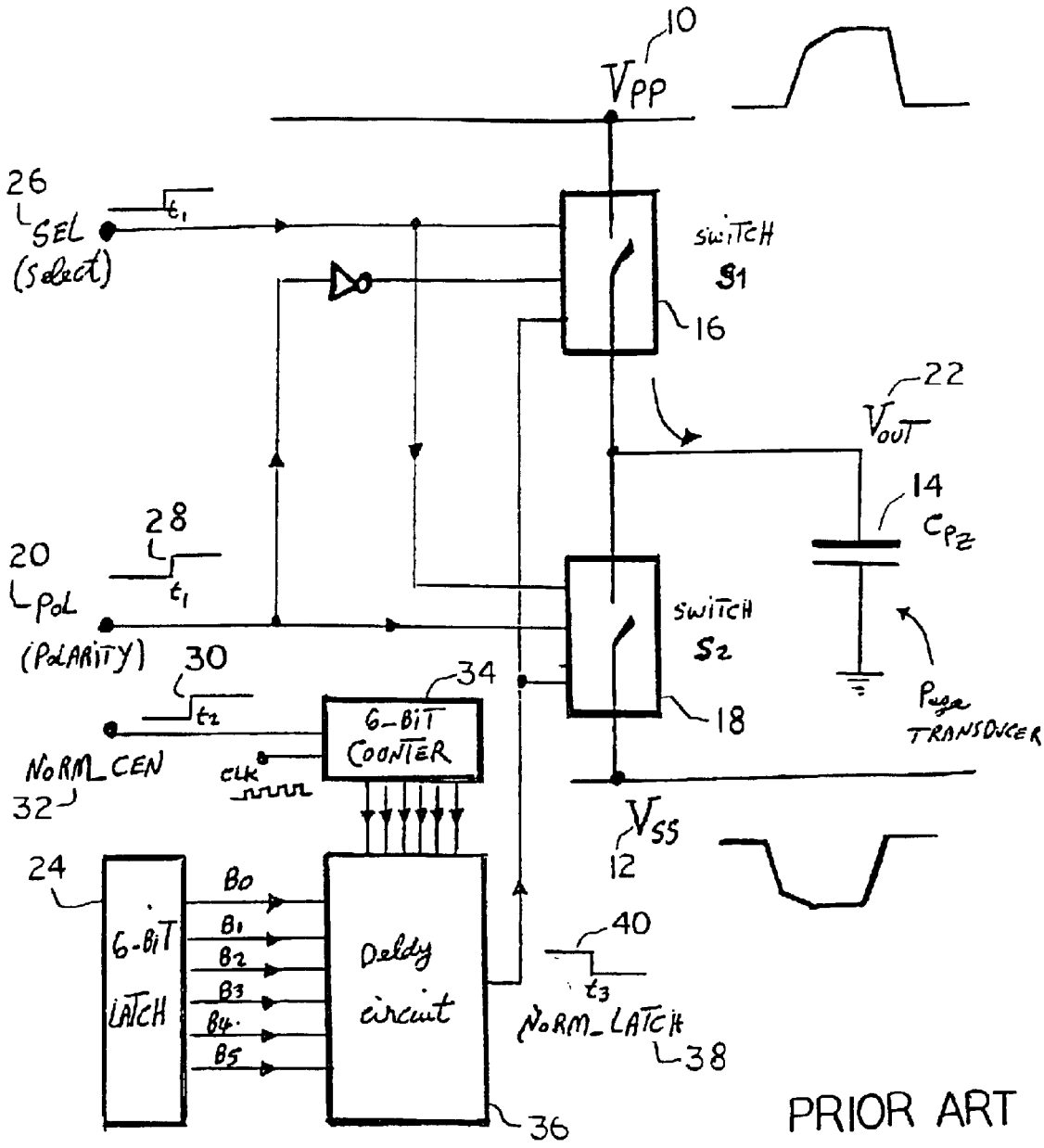
FIG. 1 is a simplified block diagram of prior art circuitry for a head driver.

In circuit shown in FIG. 1 and described above two "ramped" and "shaped" power supplies (VPP and VSS) are required. A separate power amplifier (not shown) is needed to generate such power supplies. A new circuit shown in FIG. 3 demonstrates a different approach for generating such particular waveforms across the output without the need for the power amplifier and shaped power supplies. The different waveforms of this circuit are shown in FIG. 4.

Figure 2:
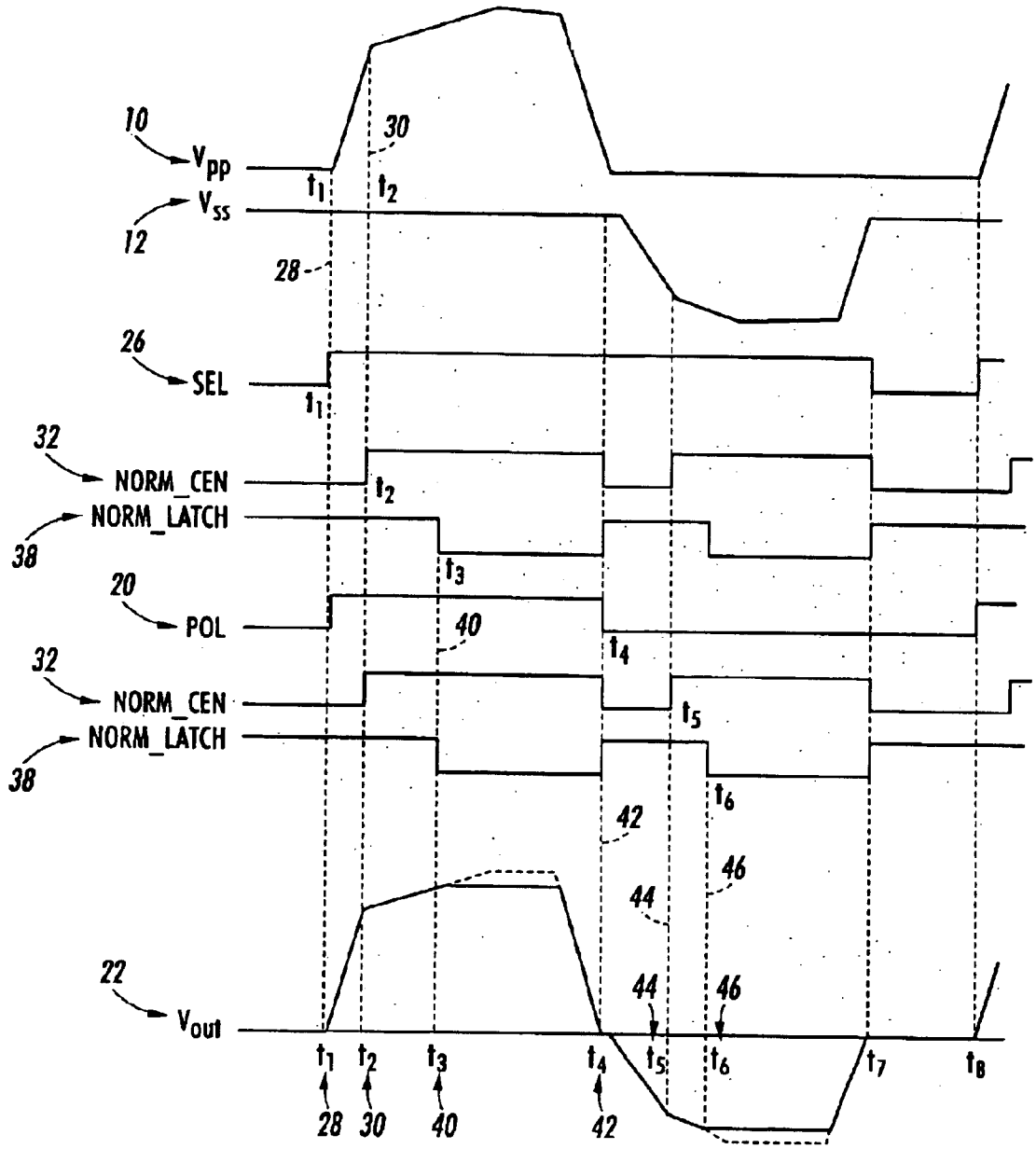
FIG. 2 PRIOR ART
FIG. 2 illustrates the related waveforms for the circuit shown in FIG. 1.
Figure 3:
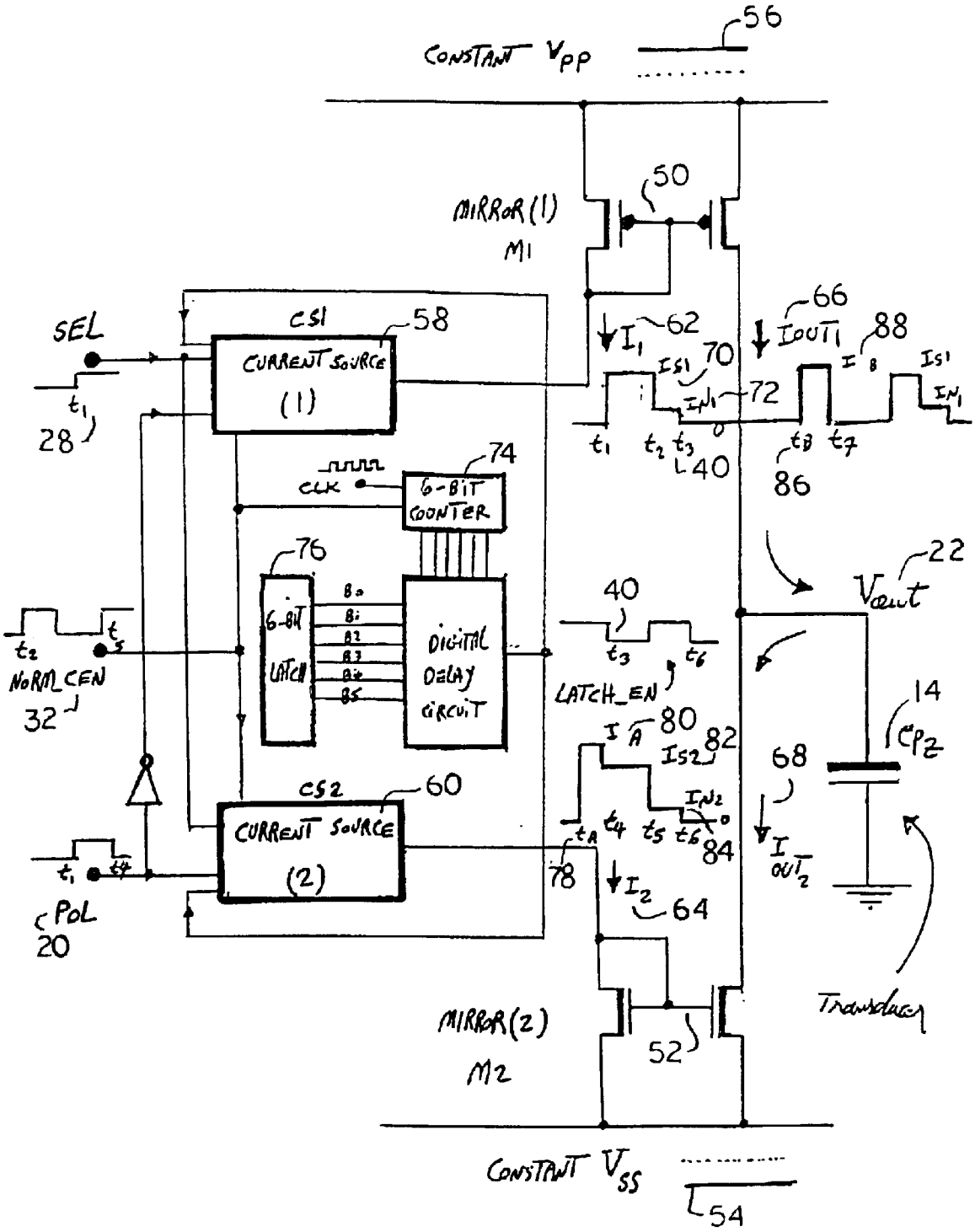
FIG. 3 is a simplified block diagram of circuitry for a head driver in accordance with the present invention.
Figure 4:
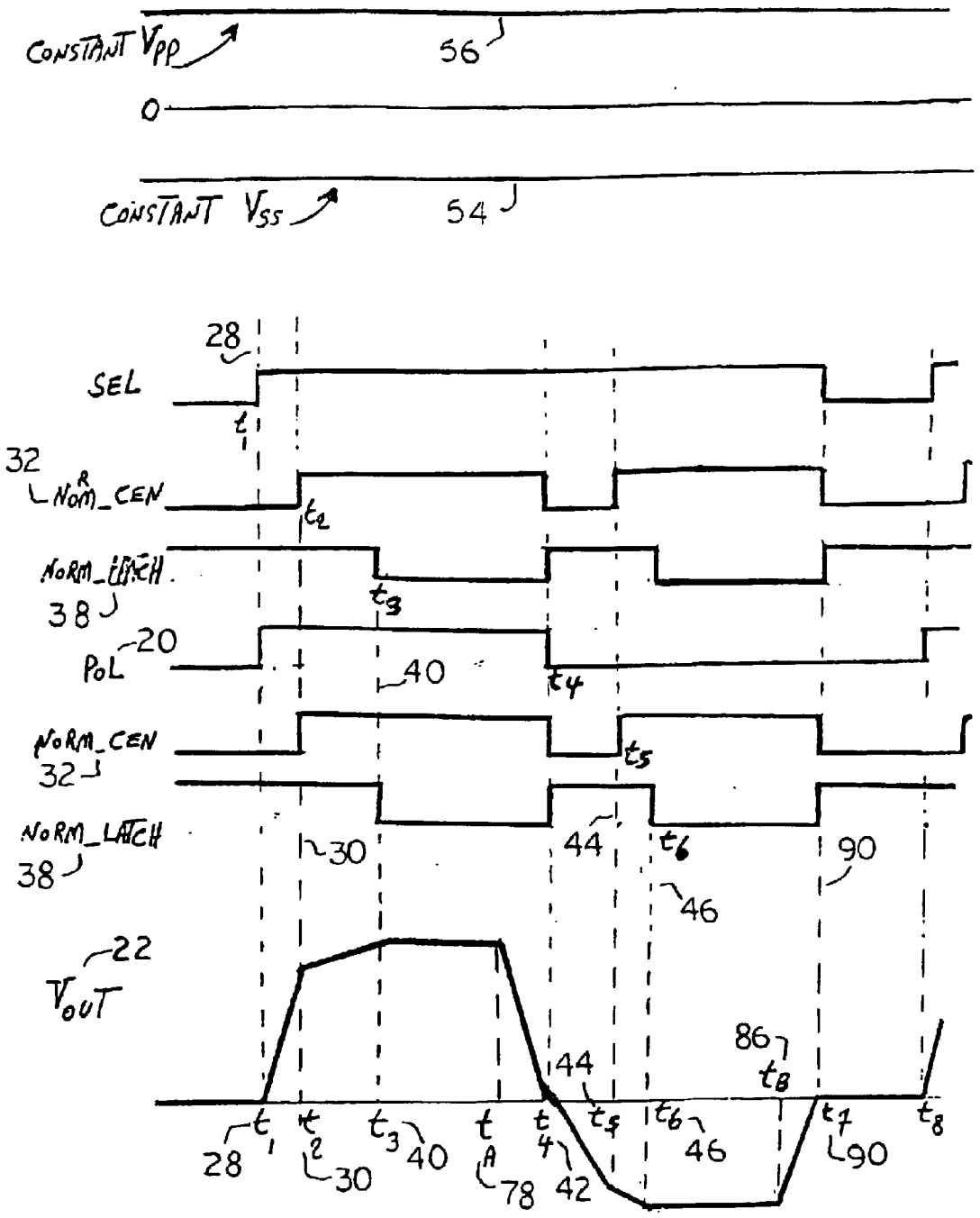
FIG. 4 illustrates the related waveforms for the circuit shown in FIG. 3.

Referring to FIGS. 3 and 4, two current mirrors M1 50 and M2 52, instead of switches S1 and S2, are used to connect the output transducer to VSS 54 and VPP 56 (constant DC power supplies). Two current sources, CS1 58 and CS2 60, generate the input current I1 62 and I2 64 for current mirrors M1 50 and M2 52 respectively. These two currents are switched to different values at different times and are amplified by mirrors M1 50 and M2 52 to provide output currents Iout1 66 and Iout2 68 and generate an output waveform identical to that of FIG. 2. For example, at t1 28, the value of I1 62 is set to a high value of IS1 70 (as shown in FIG. 3). This current is amplified by Mirror M1 50 and the amplified current Iout1 66 charges the transducer 14 to generate the high slope of Vout 22 between times t1 28 and t2 30 (fast slew slope). At time t2 30, the value of I1 62 is reduced to IN1 72 to generate the slow slope part of the Vout 22 between times t2 30 and t3 40 (normalization slope). At the same time, the "Normalization Counter Enable" signal, NORM-CEN" 32, triggers a 6-bit counter 74 similar to that described for the circuit of FIG. 1. The output of the counter 74 is compared to 6-bit normalization stored in the 6-bit latch 76. When the outputs of the counter 74 match the pre-stored normalization data, a signal "NORM_LATCH" 38 is generated which is delayed from "NORM-CEN" 32 signal with a delay time proportional to 6-bit normalization data. This signal 32 is used to set the current I1 62 (and hence Iout1) to zero. At this time t3 40, the output capacitive load keeps its voltage and Vout 22 remains constant as shown in FIG. 4 with a value determined by 6-bit normalization data. At time tA 78 while the current in mirror M1 50 is still zero, the current in mirror M2 52 is set to a value of IA 80. This current is amplified by mirror M2 52 and the output current Iout2 68 discharges the output to VSS 54 and generates the negative slope of Vout 22 between times tA 78 and t4 42.

Similarly, when the polarity changes (when POL signal 20 goes low at time t4 42) the current I2 64 in mirror M2 52 is set to IS2 82 to set the high slope part of Vout 22 between t4 42 and t5 44. At t5 44, when normalization procedure starts, this current is reduced to IN2 84 to provide a lower slope for normalization procedures of the output voltage and the 6-bit counter 74 is triggered again. At time t6 46 when the output of the counter matches the normalization data, the NORM_LATCH 38 signal goes low again and causes the current I2 64 (and hence Iout2) to be zero and Vout 22 remains its value at time t6 46 across the output capacitive load. This continues until time tB 86. At this time, while the current in mirror M2 52 is still zero, mirror M1 50 provides a sourcing current IB 88 to charge up the output until it reaches to a value of zero at time t7 90. At this time, the currents in both mirrors M1 50 and M2 52 are zero and the output voltage 22 remains at zero volts.

As described above, by this current switching scheme, the particular shape of the output voltage is obtained as shown in FIG. 4. The advantages of this approach are as follows: there is no need for separate power amplifier; the circuit provides more accuracy because the slopes of the output voltage are set separately for each individual transducer. Furthermore, as it can be seen in FIG. 3, there is no need for high voltage switching elements to disconnect the transducer from VPP and VSS (because setting the current values to zero can serve the same purpose). This simplifies the circuit further.

It should be noted that there are different ways to set the current values in mirrors M1 and M2. It can be done in current sources CS1 and CS2 to generate switching currents I1 and I2 as shown in FIG. 3 or the gain (i.e. the size ratio of two legs) of mirrors M1 and M2 can be adjusted accordingly.

While there have been shown and described what are at present considered embodiments of the invention, it will be obvious to those skilled in the art that various changes and modifications may be made therein without departing from the scope of the invention as defined by the appended claims. While the present invention will be described in connection with a preferred embodiment and method of use, it will be understood that it is not intended to it the invention to that embodiment or procedure. On the contrary, it is intended to cover all alternatives, modifications and equivalents as may be included within the spirit and scope of the invention as defined by the appended claims.

What is claimed is:

1. A circuit architecture for driving piezoelectric transducers within a head driver comprising:

current mirroring systems used to generate voltage waveforms across capacitive transducers using constant direct current power supplies, wherein the voltage waveforms are separately adjustable; and the circuit architecture being configured to enable a signal for triggering a six bit counter for generating an output.

2. The circuit architecture according to claim 1, further comprising:

first and second current sources for generating first and second input currents for first and second current mirrors.

3. The circuit architecture according to claim 2, the circuit architecture being configured to:

set a first current value high at a first time setting wherein said first current is amplified by said first current mirror and amplified current charges a transducer to generate a high slope of output voltage between said first time setting and a second time setting.

4. The circuit architecture according to claim 3, the circuit architecture being configured to:

reduce said first current value at said second time setting to generate a slow slope part of said output voltage between said second time setting and a third time setting.

5. The circuit architecture according to claim 4, the circuit architecture being configured to:

compare said output to a six bit normalization stored in a six bit latch wherein when said outputs of said counter match pre-stored normalization data, a signal is generated with a delay time proportional to six bit normalization data.

6. The circuit architecture according to claim 5, the circuit architecture being configured to:

set said first current value to zero when said signal is generated.

7. The circuit architecture according to claim 6, the circuit architecture being configured to:

set said current in said second mirror to a value equal to a predetermined current IA at a first predetermined time tA while the current in said first current mirror is still zero.

8. The circuit architecture according to claim 7, the circuit architecture being configured to:

generate a negative slope for said output voltage between times tA and a second predetermined time t4.

9. A circuit architecture for driving piezoelectric transducers within a head driver comprising:

means for generating voltage waveforms across capacitive transducers using constant direct current power supplies for driving current mirroring systems with current switching techniques, wherein the voltage waveforms are separately adjustable;

and means for enabling a signal for triggering a six bit counter for generating an output.

10. The circuit architecture according to claim 9, further comprising:

means for generating first and second input currents for first and second current mirrors using first and second current sources.

11. The circuit architecture according to claim 10, further comprising:

means for switching to different values at different times said first and second input currents and amplified by said first and second mirrors to provide first and second output currents for generating an output waveform.

12. The circuit architecture according to claim 11, further comprising:

means for setting a first current value high at a first time setting wherein said first current is amplified by said first current mirror and amplified current charges a transducer to generate a high slope of output voltage between said first time setting and a second time setting.

13. The circuit architecture according to claim 12, further comprising:

means for reducing said first current value at said second time setting to generate a slow slope part of said output voltage between said second time setting and a third time setting.

14. The circuit architecture according to claim 13, further comprising:

means for comparing said output to a six bit normalization stored in a six bit latch wherein when said outputs of said counter match pre-stored normalization data, a signal is generated with a delay time proportional to six bit normalization data.

15. The circuit architecture according to claim 14, further comprising:

means for setting said first current value to zero when said signal is generated.

16. The circuit architecture according to claim 15, further comprising:

means for setting said current in said second mirror to a value equal to predetermined current at a predetermined time while the current in said first current mirror is still zero.

17. A circuit architecture for driving piezoelectric transducers within a head driver comprising:

current mirroring systems used to generate voltage waveforms across capacitive transducers using constant direct current power supplies;

first and second current sources for generating first and second input currents for first and second current mirrors; and said first and second input currents switched to different values at different times and amplified by said first and second mirrors to provide first and second output currents for generating an output waveform, wherein the voltage waveforms are separately adjustable; and the circuit architecture being configured to enable a signal for triggering a six bit counter for generating an output.

* * * * *